US005463922A

United States Patent [19]

Mori

[11] Patent Number: 5,463,922

[45] Date of Patent: Nov. 7, 1995

[54] PUNCH FOR MAKING A MULTIPLICITY OF HOLES

[75] Inventor: Chuzo Mori, Tateishi, Japan

[73] Assignee: Carl Manufacturing Co., Ltd., Tokyo, Japan

[21] Appl. No.: 294,994

[22] Filed: Aug. 24, 1994

[30] Foreign Application Priority Data

Aug. 25, 1993 [JP] Japan ..... 5-232533

[51] Int. Cl.[6] ..... B26D 5/08

[52] U.S. Cl. ..... 83/622; 83/588; 83/619

[58] Field of Search ..... 83/622, 619, 588, 83/627, 628, 620, 582

[56] References Cited

U.S. PATENT DOCUMENTS

| | | | |
|---|---|---|---|
| 767,914 | 8/1904 | Phillippi | 83/622 |
| 3,227,023 | 1/1966 | Bouvier | 83/622 |
| 4,125,045 | 11/1978 | Jeremic | 83/588 |
| 4,509,397 | 4/1985 | Mori et al. | 83/619 |
| 4,742,744 | 5/1988 | Lindberg | 83/588 |
| 5,044,242 | 9/1991 | Chiang | 83/622 |
| 5,069,097 | 12/1991 | Mori | 83/588 |

FOREIGN PATENT DOCUMENTS

| | | | |
|---|---|---|---|
| 1373 | 6/1855 | United Kingdom | 83/622 |

*Primary Examiner*—Rinaldi I. Rada
*Assistant Examiner*—Charles Goodman
*Attorney, Agent, or Firm*—Gary M. Nath; Nath & Associates

[57] ABSTRACT

A punch for making a multiplicity of holes in a line even through a multiplicity of sheets of paper put one upon another includes a multiplicity of vertically disposed and vertically movable cutting tools supported in a row by a horizontally disposed rail. Each tool is provided with a horizontally disposed actuator pin attached to it at right angles to it. A slider is slidable along the rail for causing the pins to move the tools vertically one after another. The slider has a pair of curved guide grooves in which the opposite ends of each pin are engageable, or a roller having a pair of annular surfaces which are engageable with the opposite ends of each pin, so that the pins and thereby the tools may be vertically movable.

7 Claims, 14 Drawing Sheets

PUNCH FOR MAKING A MULTIPLICITY OF HOLES

BACKGROUND OF THE INVENTION

1. Field of the Invention

This invention relates to a punch for making a multiplicity of holes in paper.

2. Description of the Prior Art

A line of 30 holes are made in a sheet of paper having a standard size known as A4, and a line of 26 holes in a sheet of paper known as B5, when they are put in a file. FIG. 29 shows a known punch for making a multiplicity of holes in a sheet of paper having a standard size. It has a base plate 1 and a paper holder 2 attached to it rotatably, so that a sheet of paper 3 may be held in position between the base plate 1 and the paper holder 2. A ruler 4 forms an integral part of the paper holder 2 and has five notches 5 which are equally spaced apart from one another. A punch proper 6 has a protrusion 7 which is engageable with the notches 5 one after another, while it is slidable along the ruler 4 to make holes in the paper 3. The punch proper 6 has a cutting tool which can make six holes at a time. The punch proper 6 includes a spring, and is grasped and depressed by overcoming the force of the spring to cut holes.

The punch shown in FIG. 29 is of the smallest size available in the art, and is a very handy piece of office equipment which is convenient for use and storage. A considerably large grasping power is, however, required for operating the punch proper 6 by overcoming the force of the spring to cut six holes at a time. Therefore, the punch is useful for making holes through at most five sheets of paper at a time, and is difficult to employ for making holes through any greater number of sheets of paper at a time.

FIG. 28 shows another known type of punch designed for making 30 or 26 holes at a time. It includes a table 1 and a main body 2 between which paper is held, a lever 9 for selecting the number of holes to be made, which depends on the size of the paper, and a handle 8 which can be pushed down to make 30 or 26 holes in the paper. The force exerted by the handle 8 is so great that the punch shown in FIG. 28 can effectively make holes in a multiplicity of sheets of paper. The punch is, however, so large as to occupy a large space above a desk on which it is used in an office. Moreover, it is inconvenient for handling and storage.

SUMMARY OF THE INVENTION

It is, therefore, an object of this invention to provide a punch which can make a multiplicity of holes in a sheet of paper having a standard size designated by the letter A or B, and which is small in size and yet can make holes through a multiplicity of sheets of paper at a time with a small force.

This object is attained by a punch which comprises a plurality of vertically disposed and vertically movable cutting tools supported in a row by a horizontally disposed slide rail, a plurality of horizontally disposed actuator pins each attached to one of the cutting tools at right angles thereto, and a slider provided slidably along the slide rail for causing the actuator pins to move the cutting tools vertically.

The slider is so constructed as to press down the actuator pins and thereby the cutting tools one after another to make a multiplicity of holes one after another in a line. It is sufficient to apply only a small force to make a line of holes one after another. The pins enable the cutting tools to move smoothly with the aid of only a small force, and the slider enables the punch to be small in size and yet make holes through a multiplicity of sheets of paper at a time.

Other features and advantages of this invention will become apparent from the following description and the accompanying drawings.

DETAILED DESCRIPTION OF THE INVENTION

Figure 26:
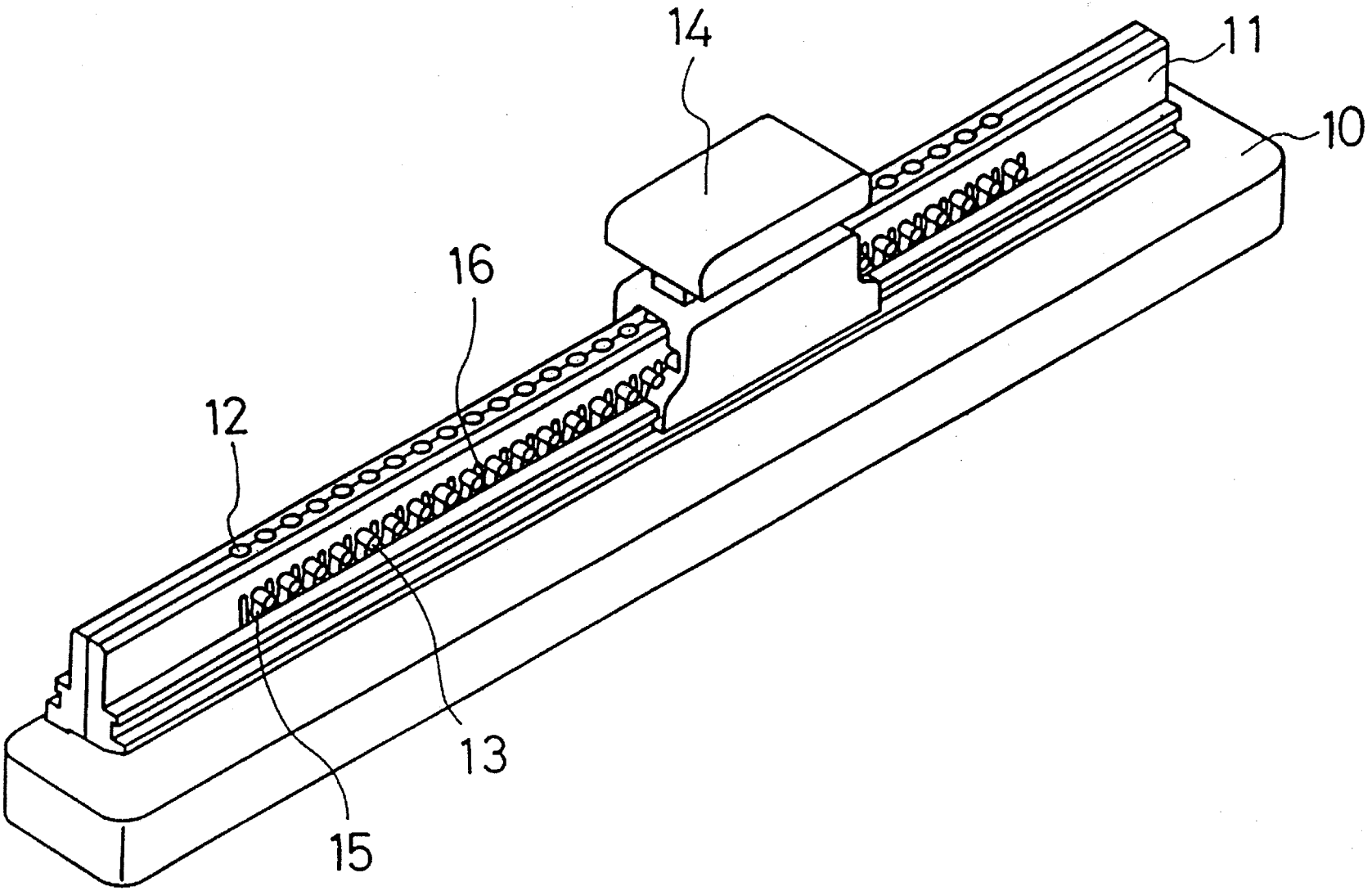
FIG. 26 is a perspective view of the punch shown in FIG. 1, with its cover taken off.

A punch embodying this invention is shown in FIG. 26. It includes a slide rail 11 secured to a base 10 and having a line of holes 12 each housing a cutting tool as will hereinafter be described in detail. The number of the holes 12 is, for example, so selected that the punch may have 30 cutting tools to cut 30 holes in a sheet of paper having a standard size known as A4 and may also be useful for making 26 holes in a sheet of paper having a standard size known as B5.

Figure 27:
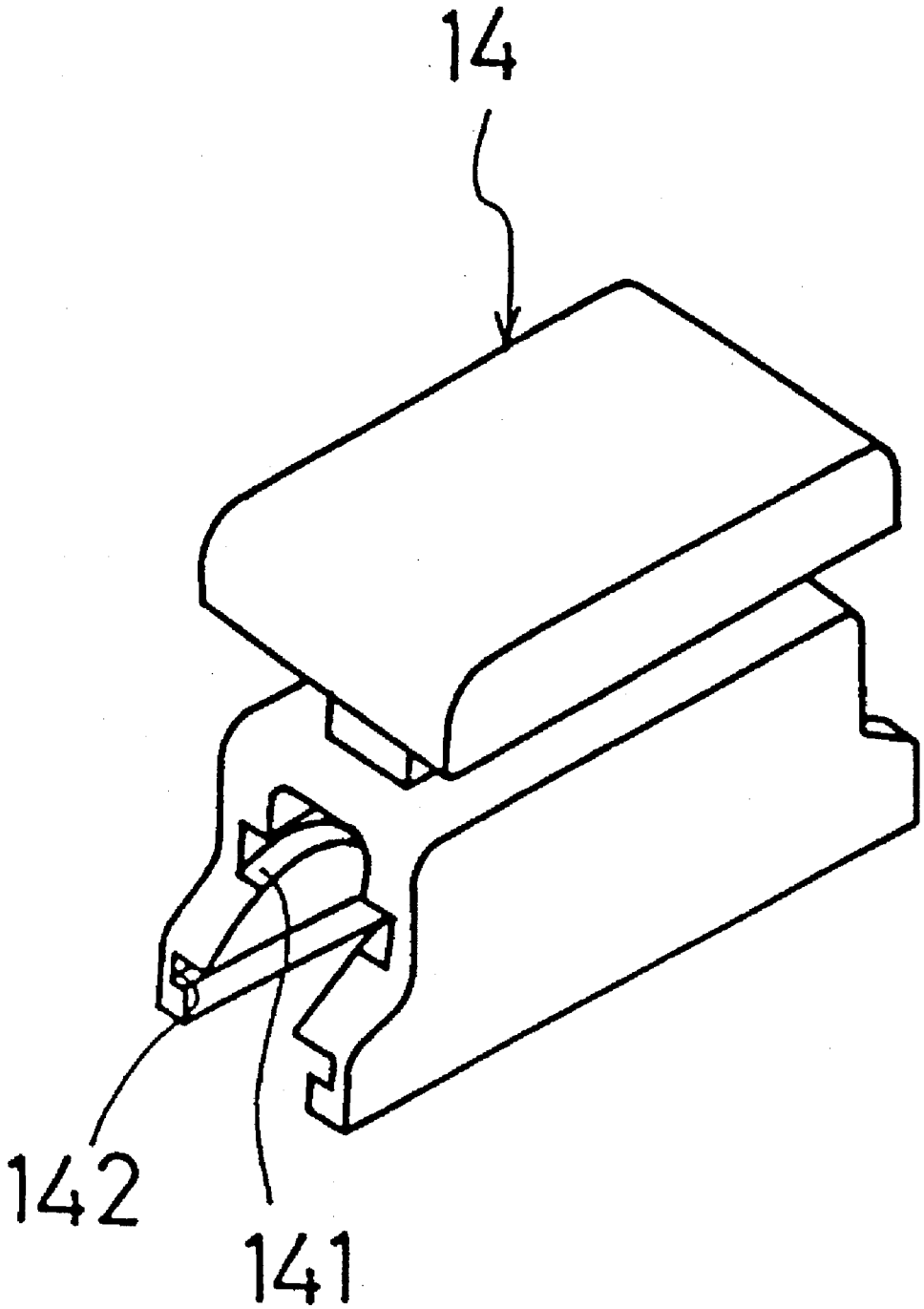
FIG. 27 is a perspective view of the slider shown in FIGS. 1 and 26.
Figure 28:
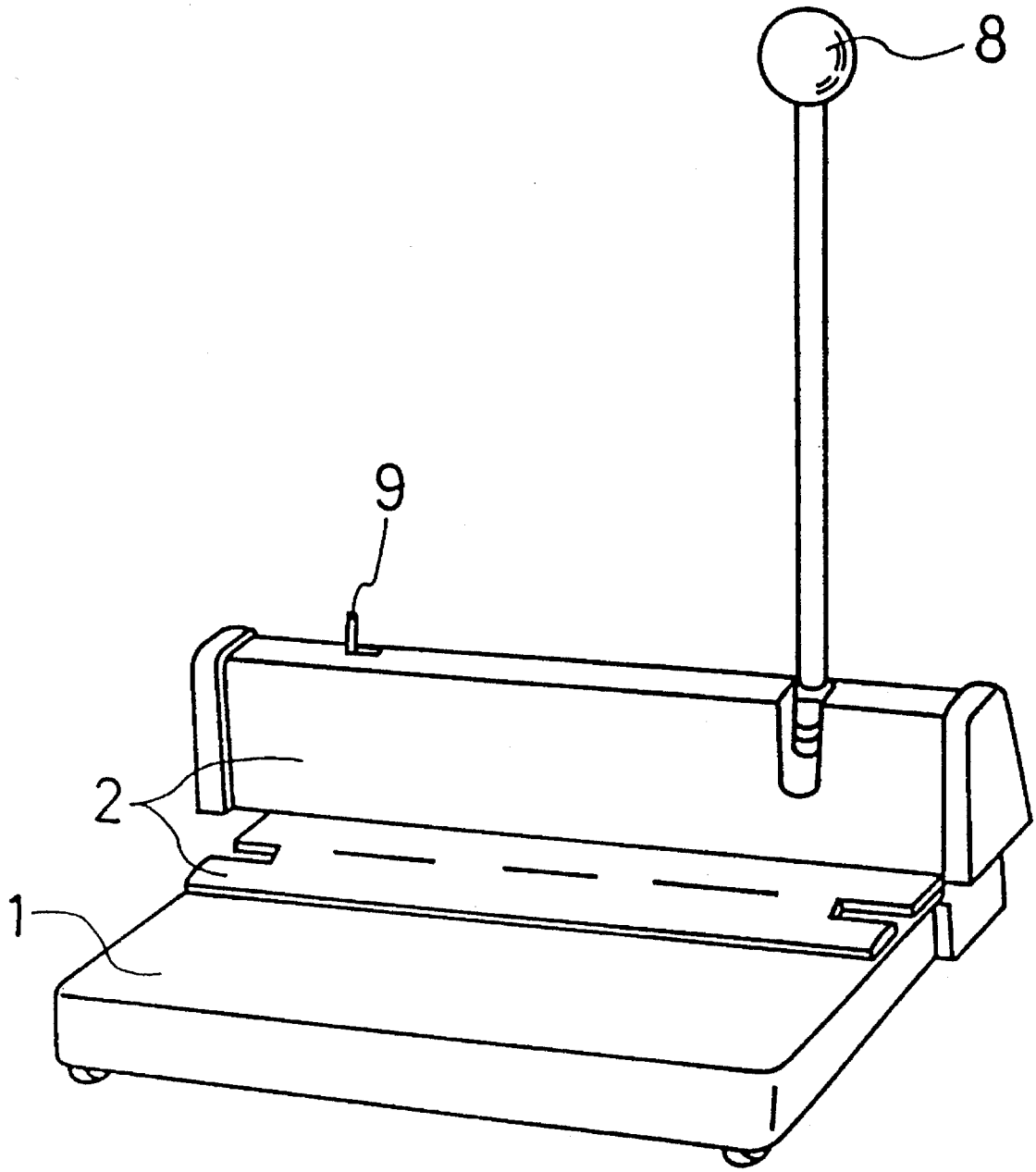
FIG.28 PRIOR ART
FIG. 28 is a perspective view of a known punch.
Figure 29:
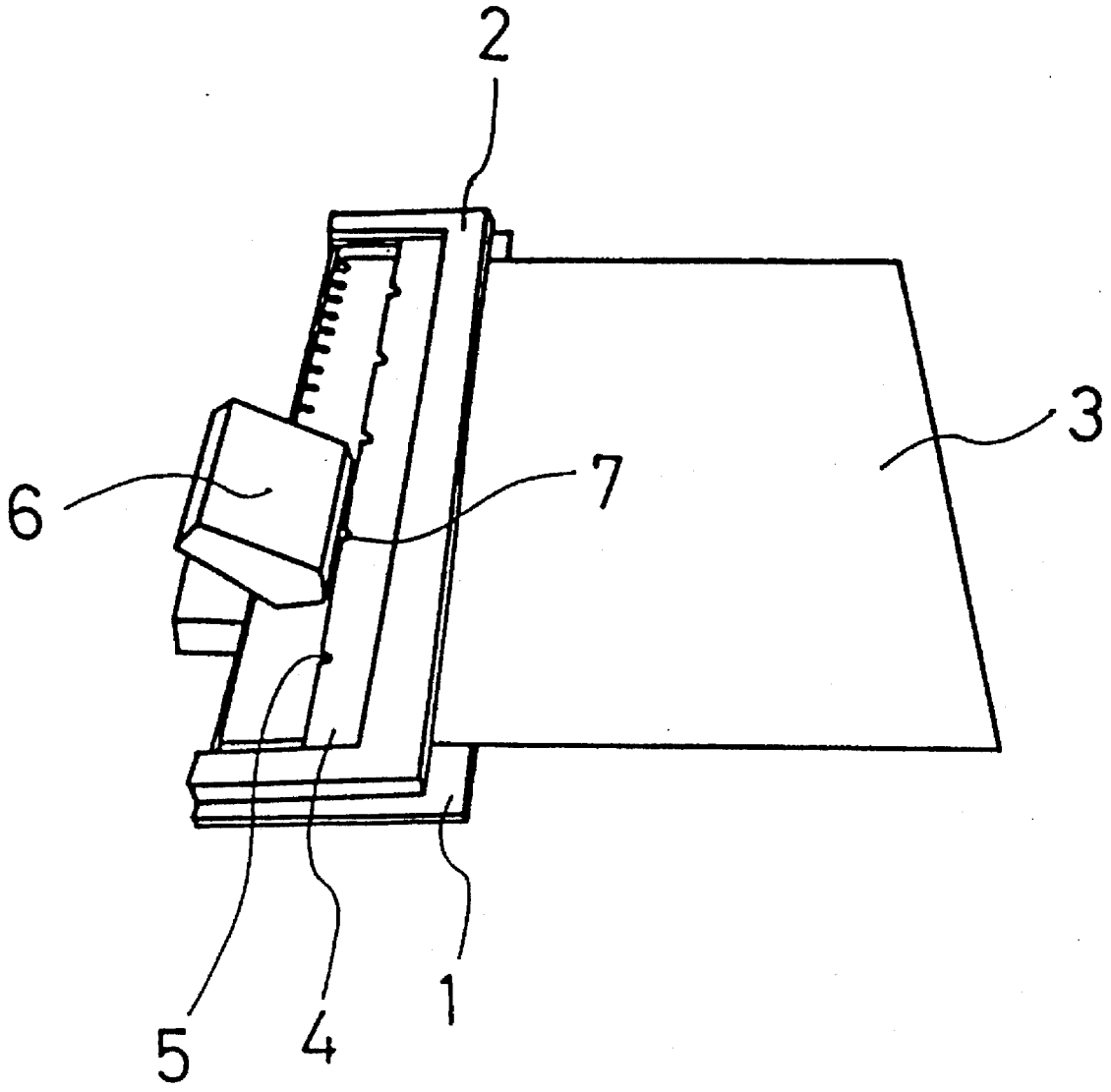
FIG. 29 PRIOR ART
FIG. 29 is a perspective view of another known punch.

The slide rail 11 is also provided on both sides thereof with a multiplicity of pairs of first slots 15 and a multiplicity of pairs of second slots 16 which are alternately formed along the slide rail 11 for the reasons which will become apparent. Each pair of first slots 15 are provided for supporting an actuator pin 13 for actuating a cutting tool. A slider 14 is fitted on the slide rail 11 and is slidable along it to engage the actuator pins 13 and thereby lower the cutting tools one after another to make a line of holes in paper. The slider 14 has an arch-shaped cross section to fit slidably on the slide rail 11 and has an inner surface provided with a pair of guide grooves 141 in which the actuator pins 13 are engageable to move the cutting tools vertically, and a pair of guide grooves 142 by which the slider 14 is slidably supported on the slide rail 11, as is obvious from FIG. 27. The slide rail 11 has a pair of longitudinally extending ridges which are slidably fitted in the guide grooves 142, respectively, of the slider 14, as is obvious from FIG. 26.

Figure 3:
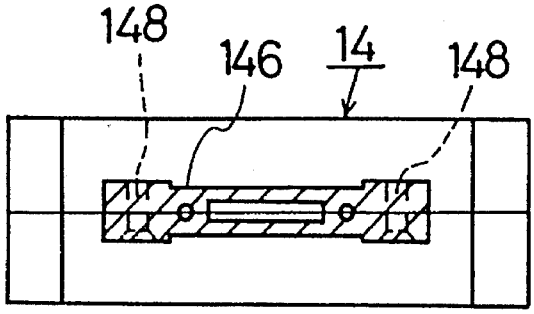
FIG. 3 is a sectional view taken along the line B—B of FIG. 5.
Figure 4:
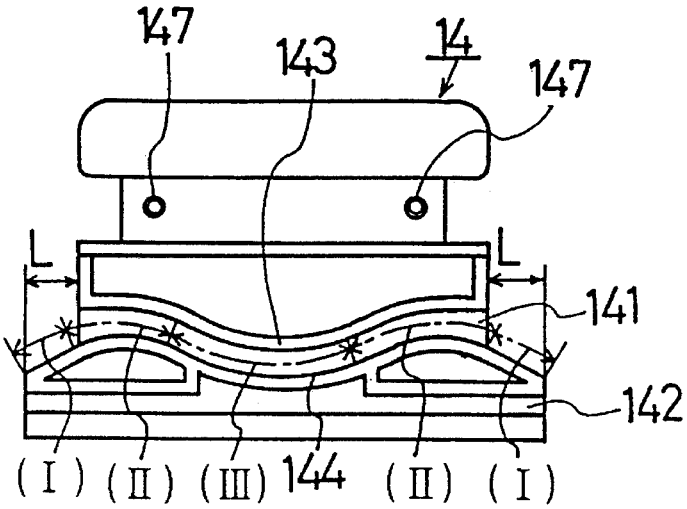
FIG. 4 is a front elevational view of a half of the slider shown in FIG. 1.
Figure 5:
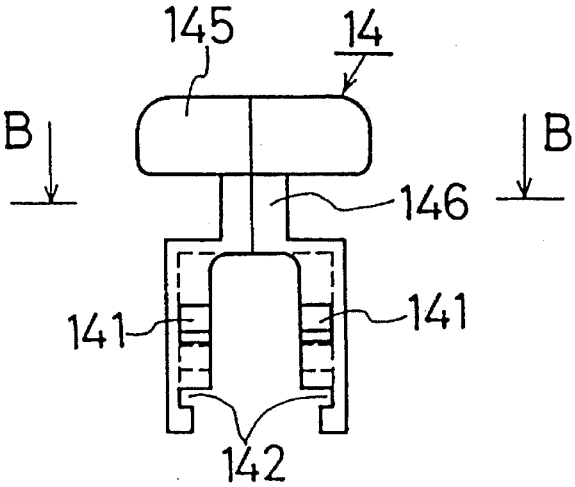
FIG. 5 is a side elevational view of the slider shown in FIG. 1.

Reference is made to FIGS. 3 to 5 showing the slider 14 in further detail. It is of the split type formed by two halves joined together. FIG. 4 shows the inner surface of one of its halves. The slider 14 has on each half thereof an upper guide surface 143 and a lower guide surface 144 which define one of the guide grooves 141 therebetween, as shown in FIG. 4. The guide surfaces 143 and 144 are both curved in a wavy form. The lower guide surface 144 has a pair of downwardly inclined end portions (I) projecting from the opposite ends, respectively, of the upper guide surface 143. Each guide groove 141 has a pair of upwardly curved end portions (II) and a downwardly curved central portion (III). Each guide groove 141 has a width which is substantially equal to the diameter of the pins 13 along the greater part of its length, but is slightly larger toward the outer end of each end portion (II) thereof. The slider 14 also has a grip 145 and a neck 146 having threaded holes 147 in which screws 148 are received for joining the two halves of the slider 14 together. It is needless to say that it is alternately possible to form the slider as a single unit.

Figure 6:
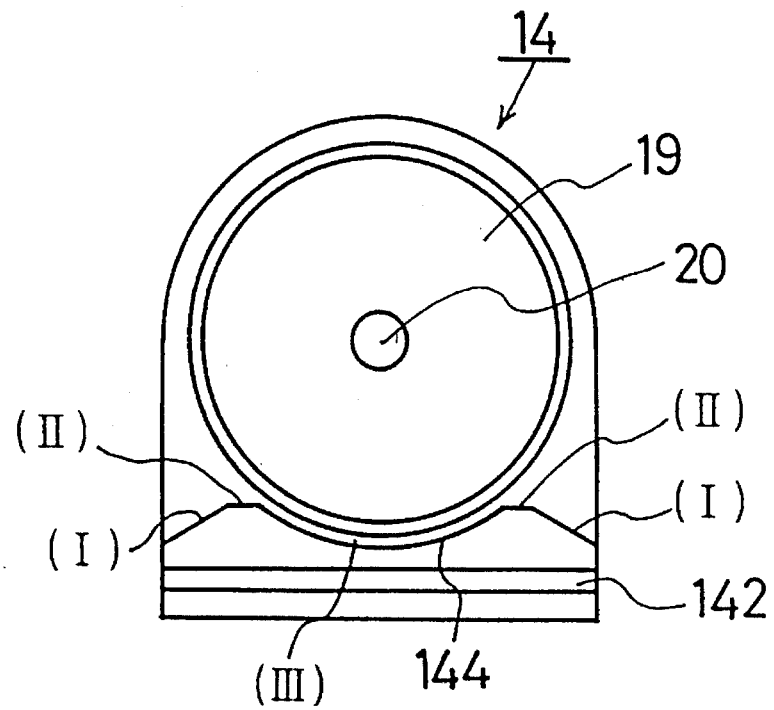
FIG. 6 is a front elevational view of a half of a modified form of slider which includes a press roller.

FIG. 6 shows a different form of slider 14. It can basically be distinguished from the slider 14 shown in FIG. 4 by including a press roller 18 having surfaces replacing the upper guide surfaces 143 shown in FIG. 4. The slider 14 has a portion 19 housing the press roller 18, and supports it rotatably at 20. The slider 14 has a pair of lower guide surfaces 144 each having a pair of downwardly inclined end portions (I) directed away from the roller 18. Each lower guide surface 144 and the adjacent peripheral surface of the roller 18 define therebetween a curved guide groove including a pair of upwardly curved end portions (II) and a downwardly curved central portion (III), and having in its central portion (III) a width which is substantially equal to the diameter of the actuator pins 13.

Figure 7:
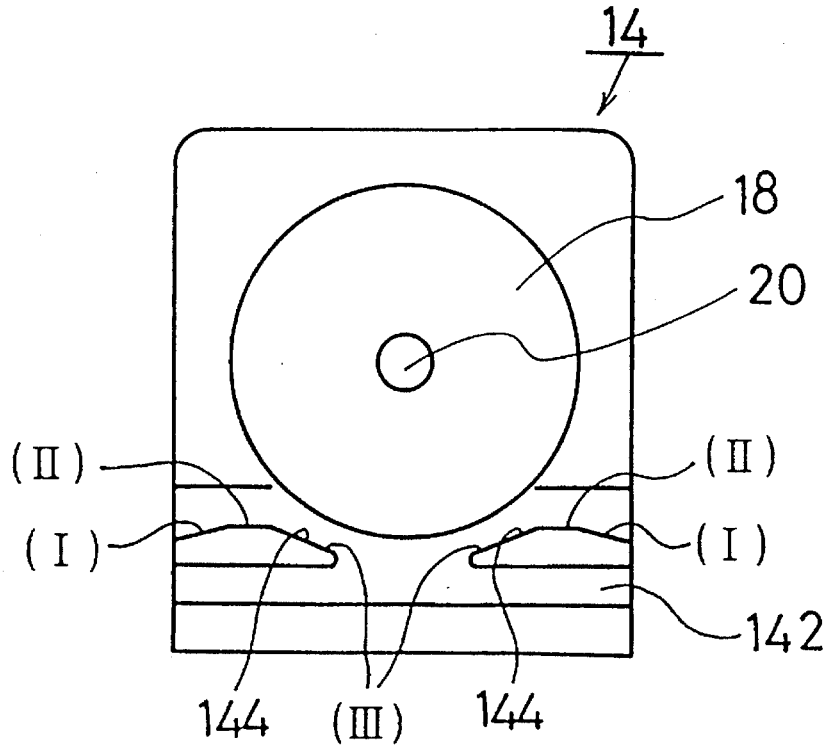
FIG. 7 is a front elevational view of a half of another modified form of slider including a press roller.

FIG. 7 shows a modified form of slider 14 including a press roller 18. It can be distinguished from the slider 14 shown in FIG. 6 in that each lower guide surface 144 is formed by a pair of separate portions, and that each guide groove defined below the roller 18 has a downwardly curved central portion (III) formed by two portions spaced apart from each other.

Figure 15:
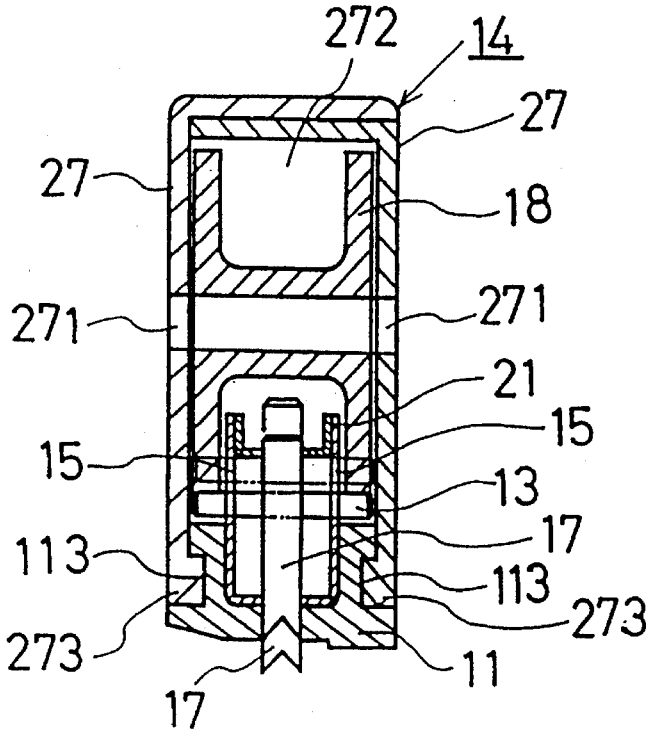
FIG. 15 is a sectional view taken along the line E—E of FIG. 14.
Figure 20:
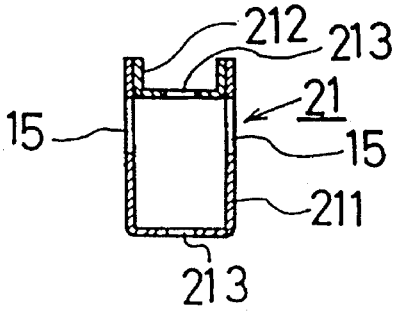
FIG. 20 is a detailed view of the cutting tool supporting member shown in FIG. 18.

Referring to FIG. 15, a tool supporting member 21 for supporting cutting tools 17 is firmly fitted in the slide rail 11. The tool supporting member 21 comprises an upper portion 212 and a lower portion 211 joined to it, as shown in FIG. 20. The tool supporting member 21 has a multiplicity of pairs of horizontally aligned slots 15 formed in both sides of its lower portion 211, and a multiplicity of pairs of vertically aligned holes 213 formed in its lower and upper portions 211 and 212. Each actuator pin 13 has a pair of ends projecting from a pair of slots 15, respectively, and each cutting tool 17 has a pair of end portions supported in a pair of holes 213, respectively, as shown in FIG. 15.

Figure 23:
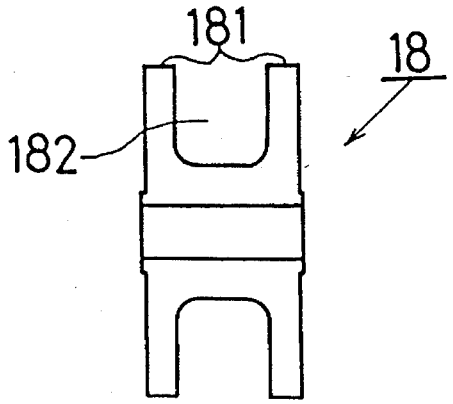
FIG. 23 is a sectional view taken along the line H—H of FIG. 22.

The press roller 18 is shaped like the letter H in side elevation, as shown in FIG. 23. It has a concavity 182 into which the tool supporting member 21 extends, as shown in FIG. 15. The roller 18 has a pair of peripheral guide surfaces 181 adapted to act upon the opposite ends of the actuator pins 13 projecting from both sides of the tool supporting member 21. The press roller 18 is rotatably supported by a roller supporting member 27 having a pair of holes 271 for a supporting shaft, as shown in FIG. 15.

Figure 14:
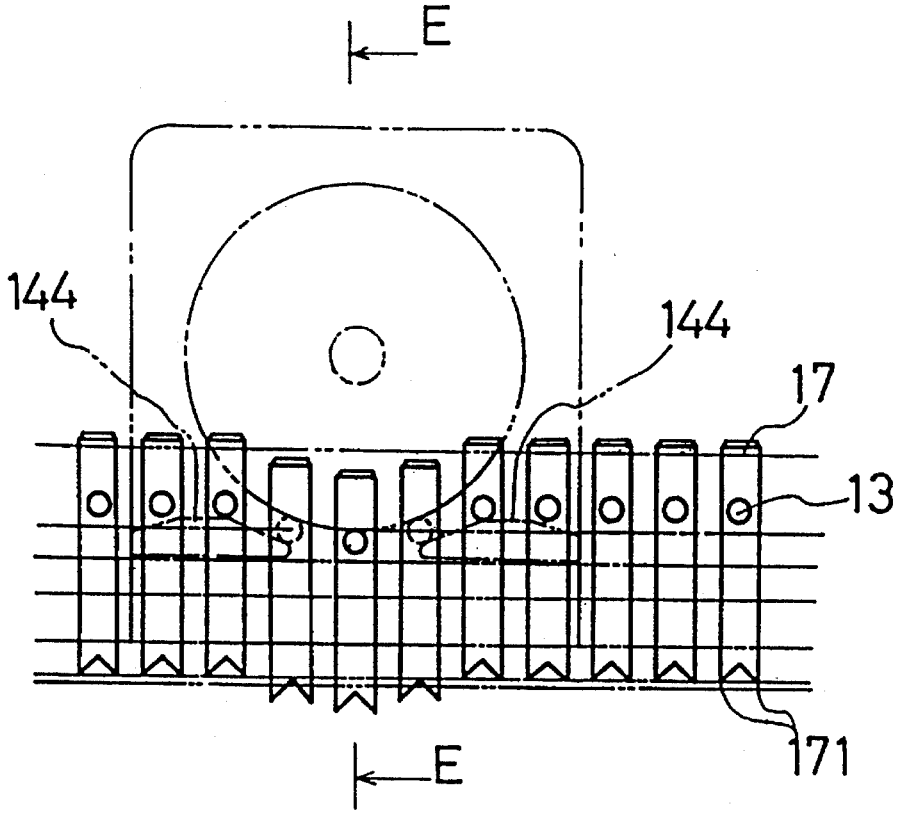
FIG. 14 is a fragmentary front elevational view of a punch including the slider shown in FIG. 7.

The roller supporting member 27 has a pair of guide ridges 273 at its bottom, and the slide rail 11 has a pair of guide grooves 113 in which the ridges 273 are slidably fitted to enable the slider 14 to slide along the slide rail 11. The roller supporting member 27 has the lower guide surfaces 144 for lowering and raising the actuator pins 13, as shown in FIG. 14.

Figure 13:
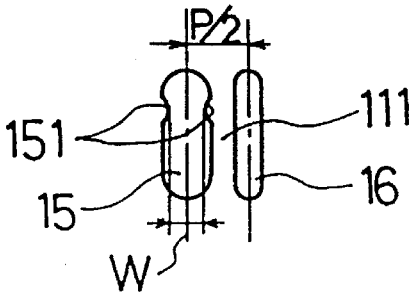
FIG. 13 is an enlarged view of two of the slots shown in FIG. 11.

Each slot 15 of the tool supporting member 21 has a constriction 151 as shown in FIG. 13. The tool supporting member 21 has also a multiplicity of different slots 16 which allow the sidewalls 111 of the side rail 11 to be flexed when the actuator pin passes the constriction 151.

Figure 8:
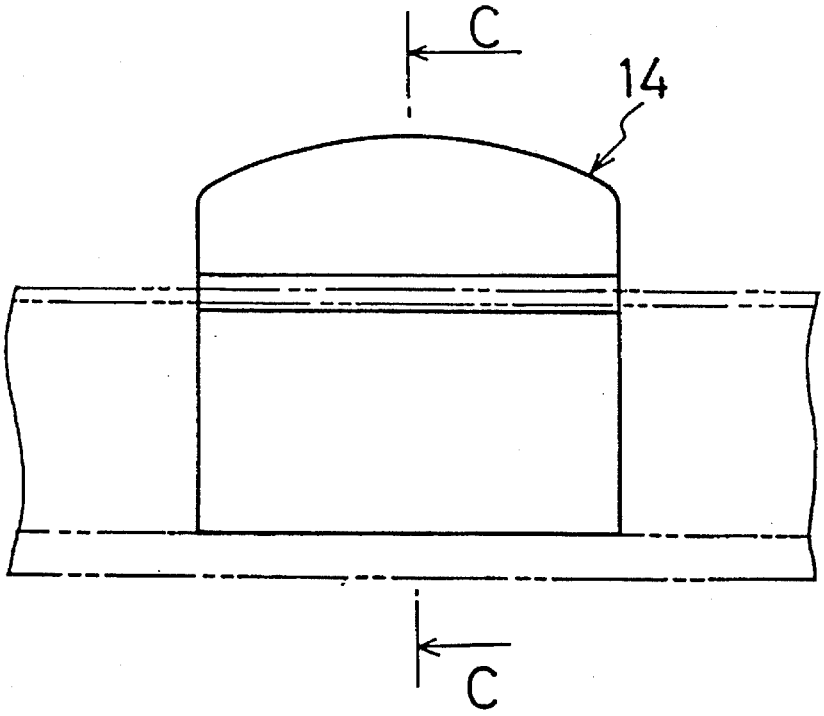
FIG. 8 is a front elevational view of a still different form of slider.
Figure 9:
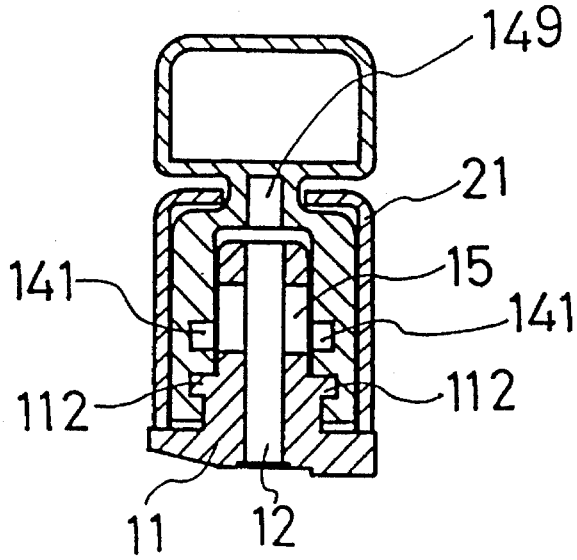
FIG. 9 is a sectional view taken along the line C—C of FIG. 8.

A different form of slider 14 is shown in FIGS. 8 and 9. It has a tool admitting hole 149 which contributes to reducing the height of the slider 14. A casing 21 is provided for covering the punch shown in FIG. 26 without it.

Figure 10:
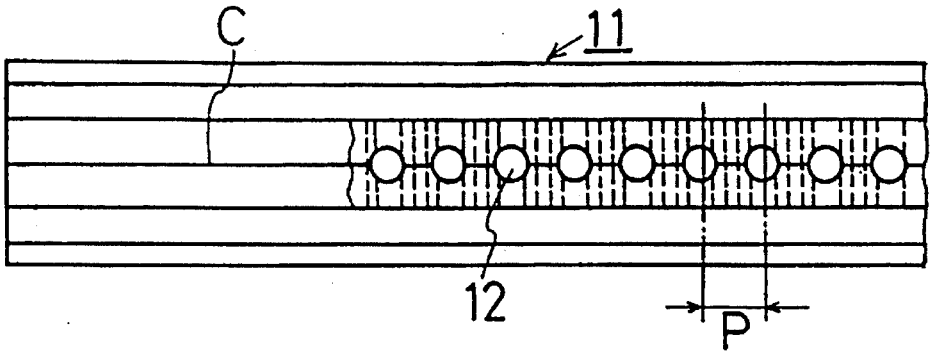
FIG. 10 is a top plan view of the slide rail shown in FIG. 1.
Figure 11:
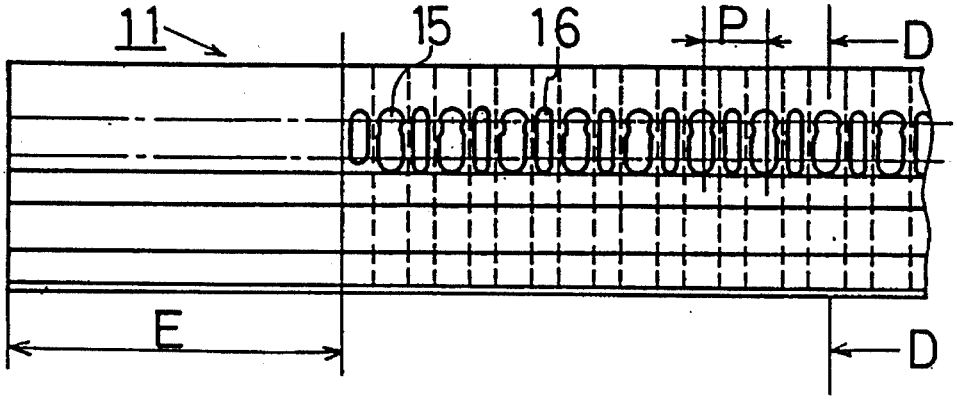
FIG. 11 is a front elevational view of the rail shown in FIG. 10.

Referring to FIG. 10, the holes 12 for the cutting tools lie on the longitudinal centerline C of the slide rail 11 and have a pitch P which is, for example, equal to the pitch of 30 holes to be cut in a standard A4 sheet of paper. The slots 15 for the actuator pins on both sides of the slide rail 11 are transversely aligned with the holes 12, as is obvious from FIGS. 11 and 12. The slide rail 11 is also provided on either side thereof with a multiplicity of different slots 16 which allow the side rail 11 to be flexed. The slots 15 and 16 are alternately formed, as shown in FIG. 11, and each slot 15 and each slot 16 adjoining it have therebetween a pitch which can be expressed as P/2, as shown in FIG. 13.

Each slot 15 has a constriction 151 as shown in FIG. 13, and the constriction 151 has a width W which is somewhat smaller than the diameter of the actuator pin 13, so that the actuator pin 13 may be held at the top of the slot 15 above the constriction 151 when it is in its raised position. The slots 16 are provided for allowing the flexing of the sidewalls 111 of the slide rail 11 to permit the actuator pins 13 to move past the constrictions 151 by widening them.

Figure 12:
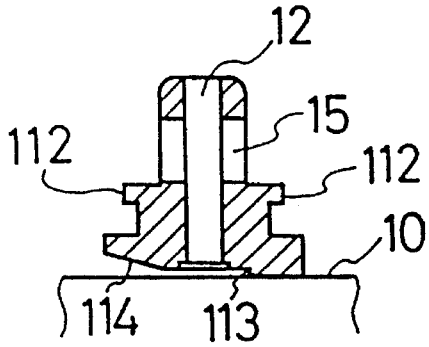
FIG. 12 is a sectional view taken along the line D—D of FIG. 11.

The slide rail 11 has a pair of longitudinally extending guide protrusions 112, as shown in FIG. 12. The protrusions 112 engage the guide grooves 142 of the slider 14 to guide its sliding motion along the slide rail 11. The slide rail 11 has a shoulder 113 at its bottom, so that the base 10 and the slide rail 11 may define therebetween a clearance in which paper can be inserted. The slide rail 11 also has an inclined bottom surface portion 114 forming a widened inlet opening for the clearance to facilitate the insertion of paper into it.

Figure 1:
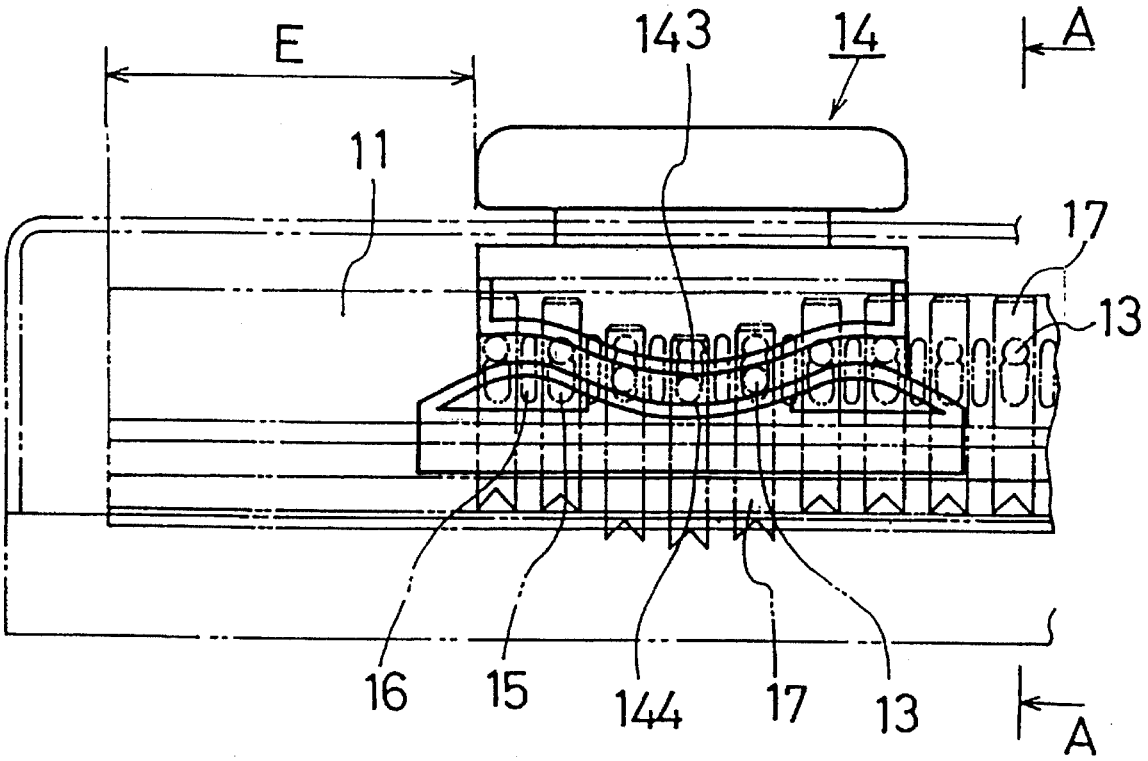
FIG. 1 is a fragmentary front elevational view of a punch embodying this invention.
Figure 2:
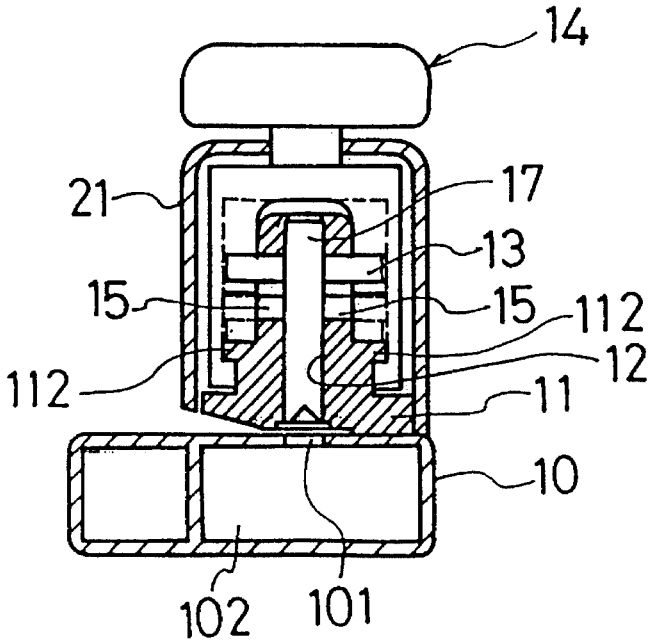
FIG. 2 is a sectional view taken along the line A—A of FIG. 1.

The slide rail 11 as shown in FIG. 12 is used with the slider 14 as shown in FIGS. 14 and 15, or FIG. 2. The tool supporting member 21 is firmly attached to the slide rail 11 and in operation the sliding motion of the the slider 14 including a press roller 18 as shown in FIGS. 6 and 7 causes movement of the downwardly curved cutting tool 17.

Each actuator pin 13 extends through one of the cutting tools 17 at right angles to it and has a pair of ends projecting in opposite directions therefrom, as shown in FIGS. 14 and 15. Referring to FIG. 2, each cutting tool 17 is disposed in one of the holes 12 in the slide rail 11 with its actuator pin 13 extending through a pair of slots 15 in the slide rail 11, and the guide grooves 142 (FIG. 27) of the slider 14 engage the guide protrusions 112 of the slide rail 11, while the projecting ends of the actuator pin 13 are fitted in the guide grooves 141 (FIG. 27) of the slider 14.

Each cutting tool 17 has a cutting edge 171 at its lower end, as shown in FIG. 14. The base 10 has a multiplicity of punching holes 101 each adapted to receive the cutting edge 171 of one of the tools 17 when the tool 17 is lowered to cut a hole in the paper placed on the base 10, as is obvious from FIG. 2. The base 10 has a hollow interior 102 below the holes 101 for receiving fragments of paper dropping as a result of punching. The slide rail 11 has a pair of end portions E not provided with any cutting tool.

In operation, the sliding motion of the slider 14 along the slide rail 11 causes the movement of the downwardly curved central portions (III) of its guide grooves 141 to lower the actuator pins 13 and thereby the cutting tools 17, whereby a line of holes are cut in the paper held in position. The guide grooves 141 are so curved that the cutting tools 17 are lowered successively one after another, and it is substantially only one of the tools 17 that is pierced through the paper at a time. Only a small force is, therefore, required for using the punch of this invention.

Each cutting tool 17 that has been lowered to cut a hole is thereafter raised at the upwardly curved portions (II) of the guide grooves 141. The actuator pin 13 for the cutting tool 17 which has been raised is caught by the constrictions 151 of the slots 15 to thereby hold the tool 17 in its raised position with its cutting edge 171 withdrawn in the hole 12. If the slider 14 is moved to either of the opposite end portions E of the slide rail 11, all of the cutting tools 17 have their cutting edges 171 withdrawn into the holes 12, thereby enabling the removal of the perforated paper and the insertion of paper to be perforated.

The slots 16 enable the sidewalls 111 of the slide rail 11 to flex between the slots 15 and 16 when the actuator pins 13 are moved past the constrictions 151 of the slots 15. This enables the smooth movement of the pins 13 past the constrictions 151 and thereby a reduction in the force required for moving the slider 14.

Each cutting tool 17 is supported at both ends in the hole 12, and the actuator pin 13 crossing it substantially at right angles to it transmits a vertical force to it when the pin 13 is moved along the slots 15. The tool 17 can, therefore, be moved smoothly along its longitudinal axis with a small amount of force. After the actuator pin 13 has been moved down past the constrictions 151 of the slots 15, no upwardly urging force acts upon the cutting tool 17, but it is sufficient to apply only such an amount of force as enables the cutting edge 171 of the tool 17 to cut a hole in the paper.

Insofar as only a small amount of force is required for moving the cutting tools 17, the use of the slider 14 is effective, and the punch of this invention is, therefore, small in size.

The foregoing description is also applicable to the operation of the punch in which the slider 14 includes a press roller 18, as shown in FIG. 6 or 7. The slider 14 including the press roller 18 has, however, an advantage over the slider 14 as shown in FIG. 4. The downwardly curved portions (III) of the guide grooves 141 in the slider 14 shown in FIG. 4 are not allowed to have a very small radius of curvature, since an undesirably large force of friction is otherwise produced between the guide surfaces and the pins 13 to resist the smooth motion of the slider 14. The roller 18 is, on the other hand, rotated to move the pins 13, and no large force of friction is produced between the pins 13 and the roller 18. Therefore, the roller 18 can be made with any of a wide variety of diameters, and if the roller 18 has a smaller diameter, the punch as a whole can be smaller, since the slider 14 can be smaller, and the end portions E of the slide rail 11 can also be smaller in length.

Figure 18:
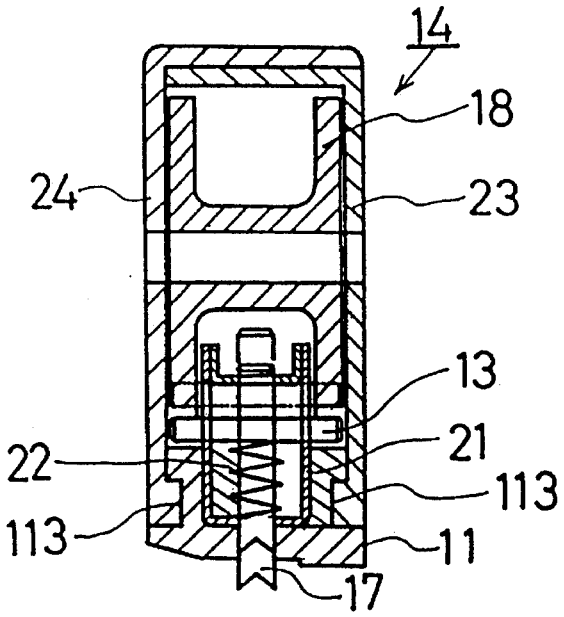
FIG. 18 is a sectional view taken along the line G—G of FIG. 17.
Figure 19:
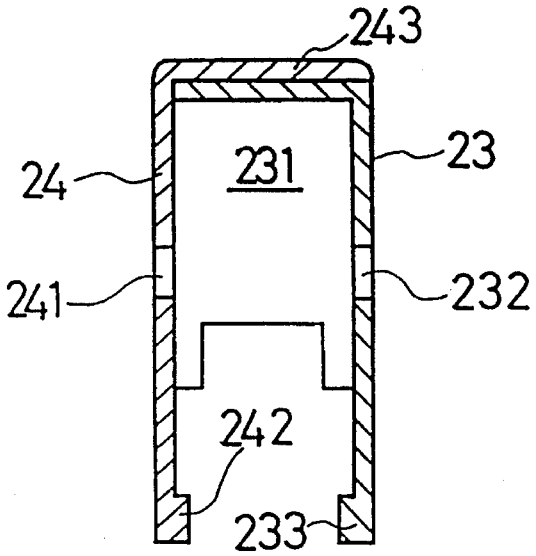
FIG. 19 is a sectional view taken along the line F—F of FIG. 16.

Attention is now directed to FIGS. 18 to 20 showing a different form of punch embodying this invention which includes a spring for holding each cutting tool 17 in its raised position. The punch includes a tool supporting member 21 fitted firmly in a slide rail 11 for supporting the cutting tools 17. The tool supporting member 21 has an upper portion 212 and a lower portion. 211, as already described with reference to FIG. 20, though it is alternatively possible to form the member 21 as a single unit shaped like a box. The lower portion 211 has a multiplicity of pairs of horizontally aligned slots 15 for supporting the actuator pins 13 and the tool supporting member 21 has a multiplicity of pairs of vertically aligned holes 213 for supporting the cutting tools 17 at its upper and lower portions 212 and 211. The slots 15 of the tool supporting member 21 have no constriction as shown at 151 in FIG. 13, nor does the member 21 have any slot 16 as shown in FIG. 13.

A coiled compression spring 22 is provided between each actuator pin 13 and the bottom of the lower portion 211 of the tool supporting member 21 and surrounds the cutting tool 17, as shown in FIG. 18. The spring 22 has a sufficiently strong resilient force to support the weight of the tool 17 and the pin 13 to hold the tool 17 in its raised position with its cutting edge 171 withdrawn in the hole 12 of the slide rail 11.

Figure 16:
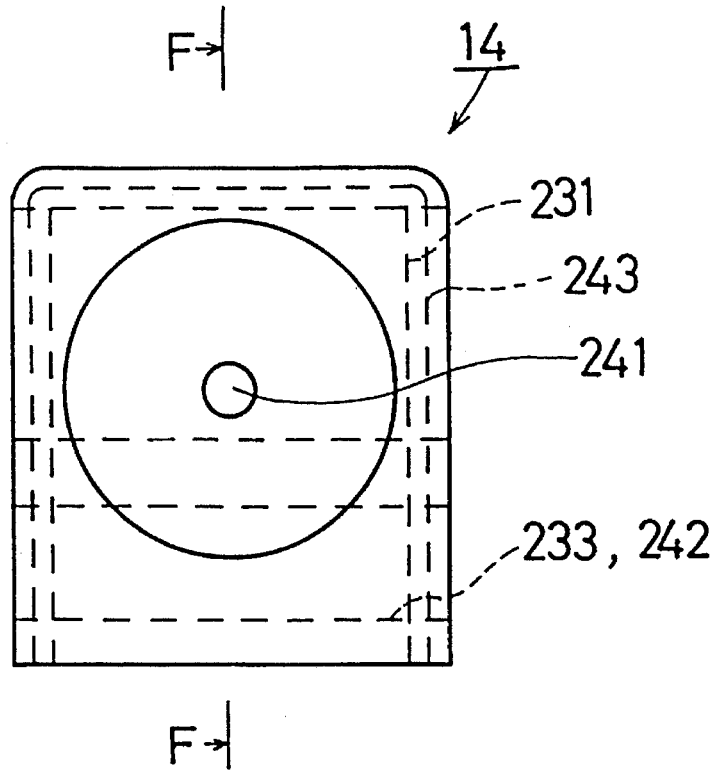
FIG. 16 is a front elevational view of a slider.

FIG. 18 also shows a press roller 18 which is rotatably supported by two roller supporting members 23 and 24. The roller 18 is enclosed by a cover 231 forming a part of the roller supporting member 23, as shown in FIGS. 16 and 19, and the roller supporting member 24 has a flange 243 to which the cover 231 is attached, whereby the roller supporting members 23 and 24 are joined together. The roller supporting members 23 and 24 have holes 232 and 241, respectively, for a shaft for supporting the roller 18 rotatably, and also guide protrusions 233 and 242, respectively, which are slidably fitted in a pair of guide grooves 113, respectively, of the slide rail 11. Neither of the roller supporting members 23 and 24 has any such lower guide surface as shown at 144 in FIG. 4.

Figure 21:
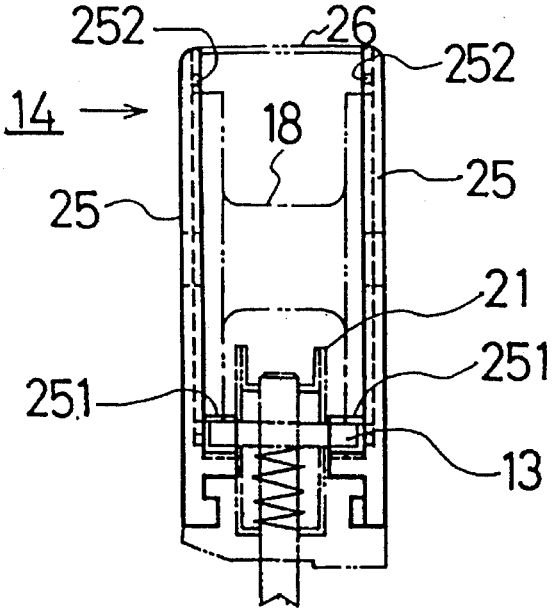
FIG. 21 is a side elevational view of a different form of slider.
Figure 22:
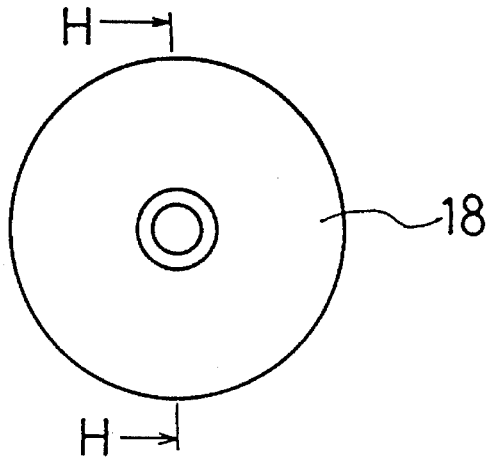
FIG. 22 is a front elevational view of a press roller.
Figure 24:
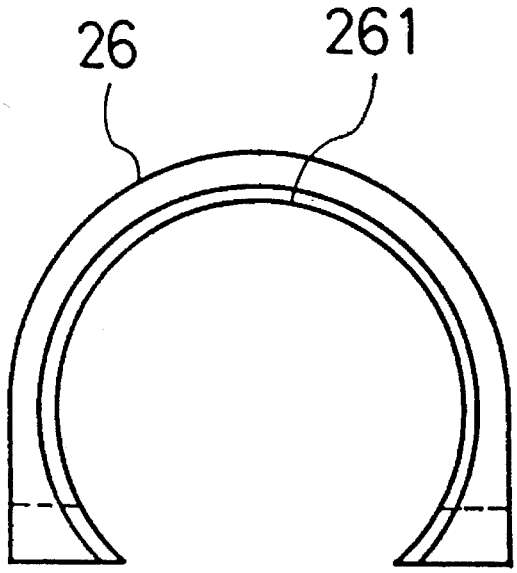
FIG. 24 is a front elevational view of the cover shown in FIG. 21.
Figure 25:
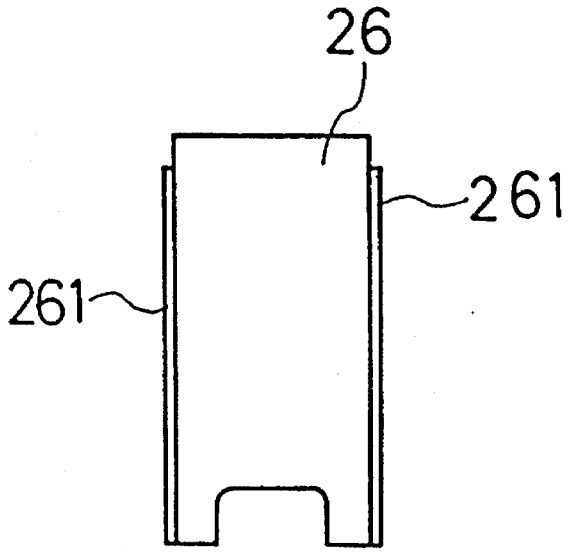
FIG. 25 is a side elevational view of the cover shown in FIG. 24.

A different form of roller supporting member is shown at 25 in FIG. 21, and has a pair of lower guide surfaces as shown at 144 in the slider 14 of FIG. 6 or 7. A cover 26 is put on the roller supporting member 25 to enclose a press roller 18. The cover 26 has a flange 261, as shown in FIGS. 24 and 25, and the roller supporting member 25 has a pair of grooves 252 in which the flange 261 is fitted, as shown in FIG. 21. The roller 18 is as already described with reference to FIGS. 22 and 23. It is shaped like the letter H in side elevation, and has an annular concavity 182 into which a tool supporting member 21 extends. The roller 18 has a pair of peripheral guide surfaces 181 adapted to act upon the opposite ends, respectively, of each actuator pin 13 projecting laterally from the tool supporting member 21.

Figure 17:
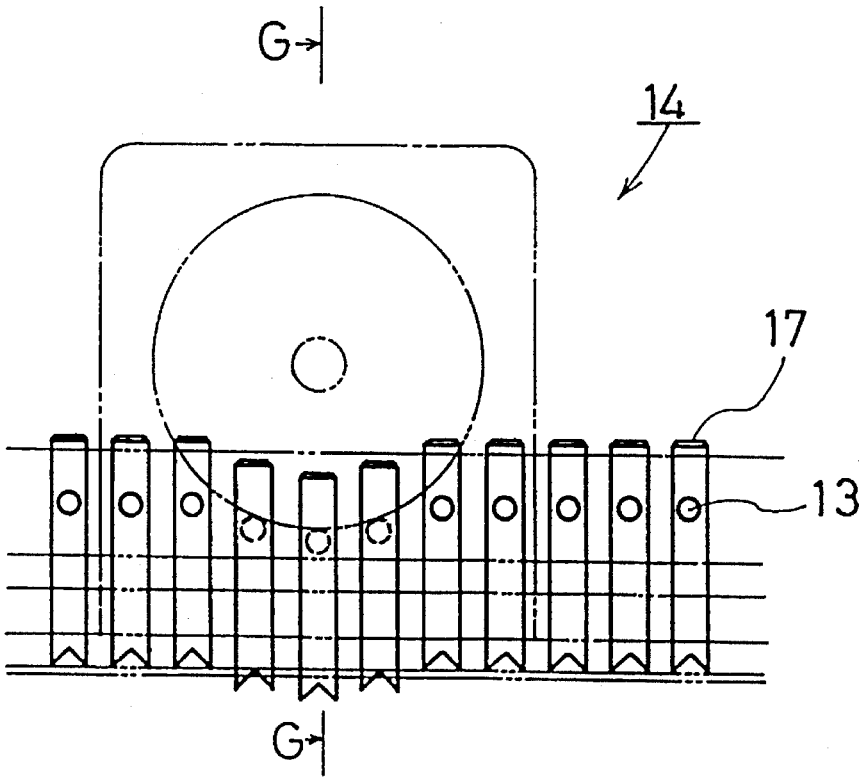
FIG. 17 is a fragmentary front elevational view of a modified form of punch embodying this invention.

The compression spring 22 for each cutting tool 17 normally holds it in its raised position, but if the slider 14 is moved along the slide rail 11, the actuator pins 13 are successively moved down by the press roller 18 overcoming the force of the springs 22 to lower the cutting tools 17 one after another into their cutting position, as shown in FIG. 17. It is substantially only one tool 17 that is pierced through paper at a time, and it is, therefore, sufficient to apply only a small amount of force to the slider 14 to cut a line of holes in the paper.

As each cutting tool 17 is supported at both ends by the tool supporting member 21, the actuator pin 13 acted upon by the roller 18 transmits a vertical force to the tool 17 along its longitudinal axis and thereby enables its smooth vertical movement. Although it is necessary to overcome the force of the spring 22 to lower the cutting tool 17, it is sufficient to apply only a small amount of force, since the force of the spring 22 is substantially not more than is required for supporting the weight of the tool 17 and the actuator pin 13, and since it is only one tool 17 that is actually used for cutting a hole at a time. The slider 14 having the lower guide surfaces 144, as shown in FIG. 21, makes it sufficient to apply a still smaller amount of force, since the lower guide surfaces 144 force each tool 17 away from the paper and permit the spring 22 to have a weaker force.

The use of the springs 22 makes it easier to prepare the slide rail 11, since it is no longer necessary to form any constriction 151 in the slots 15, or any slot 16. The advantages of the slider 14 and the press roller 18 have already been stated.

The punch of this invention can effectively make a line of holes through a multiplicity of sheets of paper put one upon another, since it requires the application of only a small amount of force and makes only one hole at a time. There is no displacement of the sheets from one another, since they are continuously secured together by the cutting tools acting one after another upon them.

What is claimed is:

1. A punch for making a multiplicity of holes comprising:

a slide rail having a plural number of vertical slots having A top and a bottom;

a plurality of punches, each having actuator pins mounted horizontally on and perpendicularly to the punch and being coupled slidably with said slots and means for resiliently urging said punches to the top of said slots;

a slider to move slidably along the slide rail in the longitudinal direction, the slider having at least one guide groove which is provided on an inner wall of the slider and engaged with the actuator pins of the punches while sliding on the configuration of the guide groove being arranged in a manner such that, during the sliding of the slider, said punches introduced in a preceding half of the groove in the sliding direction of the slider are forced vertically down to said bottom of said slot and in a trailing half of the groove in the sliding direction said punch is urged to the top of said slot.

2. A punch for making a multiplicity of holes according to claim 1, wherein perforations are interspaced between said slots.

3. A punch for making a multiplicity of holes according to claim 2, wherein said inner wall of said slider comprises a convex protrusion and an opposed concave protrusion, opposition of said convex protrusion and said concave protrusion defining said guide groove.

4. A punch for making a multiplicity of holes according to claim 1, wherein said inner wall of said slider comprises a convex protrusion and an opposed concave protrusion, opposition of said convex protrusion and said concave protrusion defining said guide groove.

5. A punch for making a multiplicity of holes according to the claim 1, wherein said convex surface is formed by a peripheral surface of a roller provided on the slider rotatably.

6. A punch for making a multiplicity of holes comprising:

a slide rail having a plural number of vertical slots having a top and a bottom;

a plurality of punches, each having actuator pins mounted horizontally on and perpendicularly to the punch and being coupled slidably with said slots and wherein said punches are resiliently urged to the top of said slots by means of coil springs;

a slider to move slidably along the slide rail in the longitudinal direction, the slider having at least one guide groove which is provided on an inner wall of the slider and engaged with the actuator pins of the punches while sliding on the configuration of the guide groove being arranged in a manner such that, during the sliding of the slider, said punches introduced in a preceding half of the groove in the sliding direction of a slider are forced vertically down to said bottom of said slot and in a trailing half of the groove in the sliding direction said elastic means returns said punch to said top of said slot.

7. A punch according to the claim 6, wherein a convex surface is formed by a peripheral surface of a roller provided rotatably on the slider.

* * * * *